US006364463B1

(12) United States Patent
Mizuyama et al.

(10) Patent No.: US 6,364,463 B1
(45) Date of Patent: Apr. 2, 2002

(54) ELECTROSTATIC INK JET RECORDING APPARATUS

(75) Inventors: Yosuke Mizuyama, Munakata-gun; Masaharu Ohyama, Chikushino, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/302,960

(22) Filed: Apr. 30, 1999

(30) Foreign Application Priority Data

Jun. 24, 1998 (JP) ..... 10-176872

(51) Int. Cl.[7] ..... B41J 2/06
(52) U.S. Cl. ..... 347/55
(58) Field of Search ..... 347/55, 51, 120, 347/141, 154, 103, 111, 159, 127, 128, 131, 123, 158; 399/271, 290, 292, 293, 294, 295

(56) References Cited

U.S. PATENT DOCUMENTS 4,271,416 A 6/1981 Shimizu et al.
6,130,691 A * 10/2000 Takemoto et al.

FOREIGN PATENT DOCUMENTS

| | | |
|---|---|---|
| JP | 564467 | 1/1981 |
| JP | 58215353 | 12/1983 |
| JP | 6411844 | 1/1989 |
| JP | 8295023 | 11/1996 |
| JP | 9193389 | 7/1997 |

* cited by examiner

*Primary Examiner*—Raquel Yvette Gordon
(74) *Attorney, Agent, or Firm*—Stevens, Davis, Miller & Mosher, LLP

(57) ABSTRACT

An electrostatic ink jet recording apparatus for flying an ink by applying a recording signal voltage between a recording electrode and a counter electrode. An optical density having any value in a range of 0.8 to 2.0 can be obtained by setting an angle of an ink meniscus at an tip of the recording electrode in a range of 0 to 65° or setting a distance from the tip of the recording electrode to the ink meniscus in a range of 0 to 1500 $\mu$m.

4 Claims, 6 Drawing Sheets

ELECTROSTATIC INK JET RECORDING APPARATUS

BACKGROUND OF THE INVENTION

1. Field of the invention

The present invention relates to an electrostatic ink jet recording apparatus and, in particular, to such an electrostatic ink jet recording apparatus, in which printing density can be easily controlled and appropriate printing density can be easily obtained.

2. Description of the Prior Art

Ink jet technology is widely used as low-cost, high-quality and high-speed printing technology in information recording apparatuses for office automation and individuals such as copying machines, facsimile machines, printers, word processors and the like.

With respect to principles of ink jet recording, energy generation means for flying a coloring material includes means making use of a heating resistor such as an electrothermal conversion device, means making use of a piezoelectric element such as an electromechanical transducer, and electrostatic means making use of electric energy as it is.

Among them, an electrostatic ink jet recording apparatus has a recording head, which can be produced easier than other systems and can perform gradation recording by controlling an electric signal applied to a recording electrode. In addition, since a current consumed at the time of recording is remarkably small, it can be said that the electrostatic ink jet recording technology is one that is useful as energy-saving equipment also in future. Furthermore, this technology uses an oil based pigment dispersed ink to enable performing printing, which is excellent in water resisting property, and in particular, is highly useful for office automation.

Here, a principle aspect of the electrostatic ink jet will be briefly described. As proposed in Japanese Patent Unexamined Publication No. 56-4467, when a recording voltage of several kilovolts is applied between a recording electrode filled with ink and a counter electrode holding a recording medium, and then exceeds a certain threshold value, an electrostatic force acting on the ink overcomes the surface tension of the ink, so that ink droplets are made to eject and fly from the recording electrode to the counter electrode.

Structure of a head in accordance with this principle is disclosed in, for example, U.S. Pat. No. 4,271,416 and Japanese Patent Unexamined Publication No. 56-4467. With structures in these examples, as shown in FIG. 11, any nozzle hole is not necessarily required for each recording electrode, but an ink ejection portion may be of so-called slit type to be common to a plurality of recording electrodes. This type of structure has a feature in dispensing with a nozzle or nozzles to thereby reduce clogging due to drying of ink. Therefore, with this arrangement, several hundred of recording electrodes are provided to be greatly effective not only for a so-called serial type head, which scans in a widthwise direction of a recording medium, but also for a so-called full-line type head having a recording electrode extending over the width of the recording medium.

In this type of electrostatic ink jet, in order to actuate respective recording electrodes independently, it is necessary to prevent leakage of electric charges, which each recording electrode may make a closed loop with an adjacent electrode to cause. Therefore, an oil based solvent having high electrical resistance is usually used as a solvent for ink. An example shown in Japanese Patent Unexamined Publication No. 58-215353 uses an oil based ink having specific resistance of approximately 108 Ω·cm, surface tension of 18 dyne/cm, viscosity of 2–30 cP, and specific gravity of 1.0 g/cm3. However, the oil based solvent is lower in surface tension than a water solvent (having surface tension of about 70–80 dyne/cm) is. Therefore, the oil based solvent is problematic in that, when printing is performed, both particles of a coloring material and the solvent rapidly permeate into fibers of recording paper to cause reduction of printing density, bleeding and offset. This is because the particles of coloring material and an oil carrier liquid that is a solvent for the particles are made to fly at the same time.

In contrast, as disclosed in Japanese Patent Unexamined Publications Nos. 8-295023 and 9-193389, it has been attempted to solve this problem by applying the electrostatic force only to the particles of coloring material from the ink. Although the ejecting principle is not necessarily elucidated in these examples, the above-described problem is solved because an electrostatic force is made to act on only the particles of coloring material to fly only the particles of coloring material, so that the carrier fluid is not included in ejected ink. According to the contents of Japanese Patent Unexamined Publication No. 9-193389, the use of an ink having the specific resistance of 1010 Ω·cm or higher makes printing density very high to provide a particularly desirable effect in sharpness of contour.

However, since no or exceedingly little spreading into a recording medium is caused when only the particles of coloring material are ejected, the optical density of printed dot becomes too high, so that an optical reflectance of a printed image will decrease remarkably. As a result, brightness of a color image reduces whereby a defect is newly found that a color reproduction range becomes narrow to provide a generally dark image quality.

Furthermore, in the prior technology, the principle of ejecting only the particles of coloring material from the ink causes high density of ink at a tip of the recording electrode to increase the viscosity of the ink, thus presenting a problem that ejecting speed decreases and ejecting fails due to drying of the ink. In addition, ejecting of only the particles of coloring material makes the coloring material attaching to the recording medium nearly solid. Therefore, fixing of such coloring material necessitates a fixing process by means of temperature or pressure, which is problematically costly.

SUMMARY OF THE INVENTION

It is an object of the present invention to obtain an appropriate printing density of coloring material on a recording medium and to solve problems of the prior art in an electrostatic ink jet such as excessive reduction of printing density, bleeding, offset and the like as well as problems, caused by excessively increased density, such as reduction in color reproduction range and in recording speed, and cost increase caused by high-temperature fixing process.

To solve the above-described problems, the inventors of the invention have earnestly studied geometric dimensions of an ink meniscus in order to obtain an electrostatic ink jet head, which provides an optimum printing density and reproduces optimum colors, and is excellent in response and fixing properties. As a result, it has been found that, in the case where an angle of an ink meniscus relative to an electrode at a tip of a recording electrode is 0–65° or a distance of the ink meniscus from the tip of the electrode is 0–1500 μm, any value of 0.8 to 2.0 can be obtained for optical density to enable controlling color, response and fixing properties.

DESCRIPTION OF THE PREFERRED EMBODIMENTS

<Structure of Head>

Figure 1:
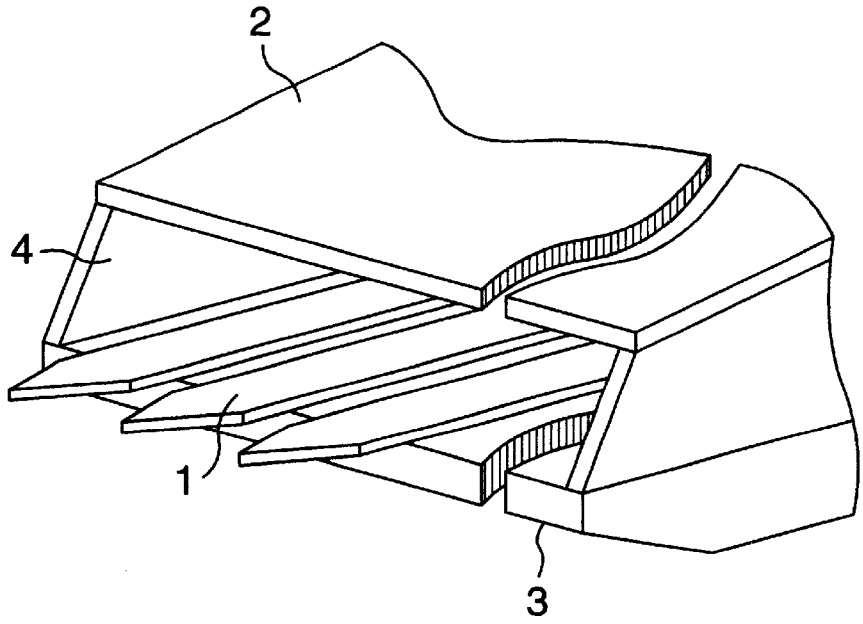
FIG. 1 is a perspective view of an electrostatic ink jet head according to the present invention.

First, the structure of an electrostatic ink jet head will be described with reference to FIG. 1. FIG. 1 is a perspective view of a so-called slit type electrostatic ink jet head, in which an ink ejection portion is common to a plurality of recording electrodes recording head comprises a recording electrode 1 for flying ink droplets by imparting an electric field, which makes a recording signal, to the ink, a substrate or base plate 3 forming the recording electrode 1, a top plate 2 holding the ink in a tip of the recording electrode 1, a slit 4 serving as an ink flow passage for supplying the ink to the recording electrode, or a common ink ejection opening; and a counter electrode (not shown) facing the recording electrode and helping the ink in ejecting and flying.

<Ink>

On the other hand, as disclosed in Japanese Patent Unexamined Publication No. 64-11844, the ink is composed of a carrier fluid, particles of coloring material dispersed in the carrier fluid, a resin partially dissolved in the carrier fluid, and an addition agent for controlling physical properties of the ink.

In the carrier fluid are used: an aliphatic hydrocarbon solvent such as mineral spirit, hexane, and an isoparaffin-based petroleum solvent; an aromatic hydrocarbons solvent such as toluene and xylene; an ester based solvent such as ethyl acetate and butyl acetate; a ketone based solvent; a glycol based solvent; a glycol-ether-based solvent; a glycol-ether-ester-based solvent; and the like. Solvents having a high specific resistance are usually used in the electrostatic type ink jet mechanism, and thus Japanese Patent Unexamined Publication No. 64-11844 discloses examples such as an isoparaffin-based solvent, silicone oil, and the like. These solvents have a specific resistance of 1010 Ω·cm or higher, and a dielectric constant of about 2. The carrier fluid used in the prior art serves as imparting fluidity to the particles of coloring material and the addition agent as meant by the term "carrier," and so does not play any important role. However, the present invention makes the carrier fluid play a functional, important role in not only imparting fluidity to the particles of coloring material but also regulating the printing density.

The above-described resin includes a natural resin such as rosin, a natural resin derivative such as rosin ester, or a synthetic resin such as an acrylic resin, an alkyd resin, and a polyester resin, and is used for the purpose of combining the particles of coloring material with the carrier fluid for dispersion of and prevention of sedimentation of the particles of coloring material, as well as for the purpose of regulation of viscosity and fixing.

As the particles of coloring material, a conventional coloring agent used in liquid developers for the electrostatic photograph and in printing ink is employed. Concretely, carbon black is used as the black pigment, a diazo-yellow-based pigment is used as the yellow pigment, an azo-lake pigment is used as the red pigment, and a phthalocyanine blue is used as the blue pigment. While many other coloring materials can be used, selection is performed taking account of chemical properties such as compatibility with a solvent, an addition agent and the like, physical properties such as charging property of particles of coloring material, and coloring property such as color reproducibility.

The addition agents is typified by a dispersing agent, a charging control agent, alcohol, and the like.

Used for the dispersing agent are lecithin or a metallic soap, which is effective in improving the wetting of surfaces of the particles of coloring material to prevent sedimentation of the particles of coloring material, shortening a time for dispersion process of the ink, and regulating the particle size distribution.

On the other hand, generally used as the charging control agent is a metallic soap which is composed of metal salt of carboxylic acid such as naphthenic acid and 2-octylic acid and imparts a stable potential to the particles of coloring material. The mechanism, in which such a metallic soap imparts the potential to the particles of coloring material, is comparatively clarified by a theory in the event of electrolyte being given to colloidal particles, a theory of charge distribution in the vicinity of ions in plasma, and the like.

Alcohols are added for controlling the dielectric constant of the ink. Methyl alcohol, ethyl alcohol, isopropyl alcohol and the like are used. Alcohols have a dielectric constant which is considerably larger than that of a liquid (having a dielectric constant of about 2) used as the carrier fluid, and have a relative dielectric constant, of which value is near approximately 20. Thus a material inclusive of alcohol and having the relative dielectric constant of nearly 20 or more is called "dielectric material" in the specification of this application. Therefore, a liquid, such as ISOPAR, having the dielectric constant of approximately 2 is not called a dielectric material in the specification of this application.

Figure 2:
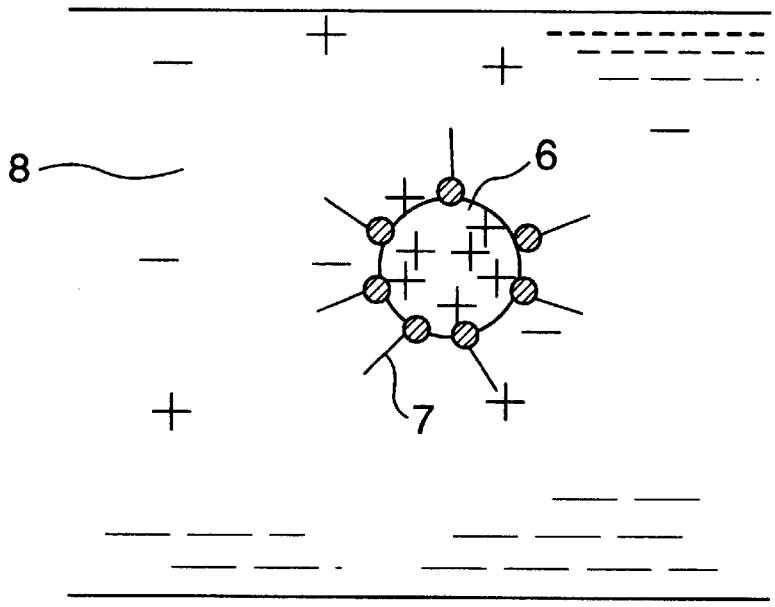
FIG. 2 is a view illustrating a charged state in ink.

Here, the operation of the electrostatic ink jet mechanism will be described in detail. Although chemical or physical states between various components in the ink are not well understood, it is believed that an image, in which attention is paid to only the carrier fluid and particles of coloring material, is as shown in FIG. 2.

A pigment 6 is naturally charged beforehand due to contact charging or other causes. FIG. 2 shows a state, in which the pigment is charged in positive polarity. It is believed that a charging control agent 7, which is dissociated or not, physically or chemically absorbs the pigment to give it a stable potential of a certain value. The carrier fluid 8 can possibly contain ions of the charging control agent, which is dissociated, and somewhat free charges.

<Principle of Ejection>

In such state, when a signal voltage is applied to the recording electrode against the counter electrode, surface charges conformed to a capacitance between the recording electrode and counter electrode as well as the above-described charges are charged with a time constant represented by a product of the resistance of the carrier fluid and the capacitance. In addition, the dielectric material such as alcohol causes dielectric polarization to generate polarized charges. Major forces acting on the ink in this case are as follows:

Forces (pressures) acting on the carrier fluid:

(c1) Atmospheric pressure (c2) Surface tension pressure; $-\sigma/r$ ($\sigma$: surface tension, r: radius of curvature of meniscus)

(c3) Electrostatic pressure; $-\epsilon E2$ ($\epsilon$: dielectric constant of ink)

(c4) Coulomb's force acting on surface charges; $- \ldots 4$ qE (q: surface density of charges, E: electric field strength)

(c5) Gravity pressure; mgH (m: density of ink, g: gravitational acceleration, H: difference of carrier levels)

Gradient force acting on the dielectric material:

(d1)$-\nabla E2(\nabla=d2/dx2+d2/dy2+d2/dz2)$

Forces acting on particles of coloring material:

(p1) Coulomb's force acting on charges of coloring material (body force); qE (q: quantity of charges)

(p2) Gravity acting on charges of coloring material; mgh (m: mass of coloring material, h: height from the bottom of flow passage)

When these forces become unbalanced and forces pushing the ink toward the counter electrode prevail, the ink is ejected. It cannot be easily found in theoretical and experimental manner how these forces balance in an equilibrium state and how they become unbalanced. Then, as the result of having studied in detail these forces and dimensions of meniscus configuration, the inventors of this application have found that the forces c3, c4, d1, and p1 relating to an electric field respond to the dimensions of meniscus configuration critically in the dimensions within a certain specified range.

It is inferred that the reason why wide optical density can be reproduced in the dimensions within such range is that the balance among the forces c3 and c4 acting on the carrier fluid, the force d1 acting on the dielectric material, and the force p1 acting on the particles of coloring material changes critically, and so a ratio of the carrier fluid and particles of coloring material in the ejected ink also changes critically.

<Distribution of Field Strength>

Next, in order to consider how the balance of forces acting on the carrier fluid and particles of coloring material changes as described above, the distribution and values of the electric field around the recording electrode are shown below. The field strength near a tip of the recording electrode is completely determined by the configuration of the ink meniscus and the quantity and distribution of the particles of coloring material in the case where the recording electrode is fixed in shape. In this case, the electric field E can be found from a potential $\phi$ determined by the following Poisson's equation:

$$d2\phi/dx2+d2\phi/dy2+d2\phi/dz2=\rho(x, y, z; t)/\epsilon(x, y, z)$$

and using $$E=(d\phi/dx,\ d\phi/dy,\ d\phi/dz)$$

where $\rho(x, y, z; t)$ and $\epsilon(x, y, z)$ indicate a charge density at a location x, y, and z and at time t, and a dielectric constant of the material at the location x, y, and z, respectively. An unknown variable to be determined in this dominant equation is the electric field E, and known constants to be given are the charge density $\rho$ and dielectric constant $\in$.

Because the charge density $\rho$ depends on how the particles of coloring material move in the carrier fluid, it is governed by the Navier-Stokes' equation and the like, and so is determined according to the configuration of the ink meniscus. It is believed that the concrete value of the charge density is several tens to several thousands Coulomb/m3.

On the other hand, the dielectric constant $\in$ also is given according to the configuration of the meniscus. The actual value assumes approximately $2\in 0$ in the case of the hydrocarbon carrier solvent. Here, $\in 0$ is the dielectric constant for a vacuum.

Figure 3:
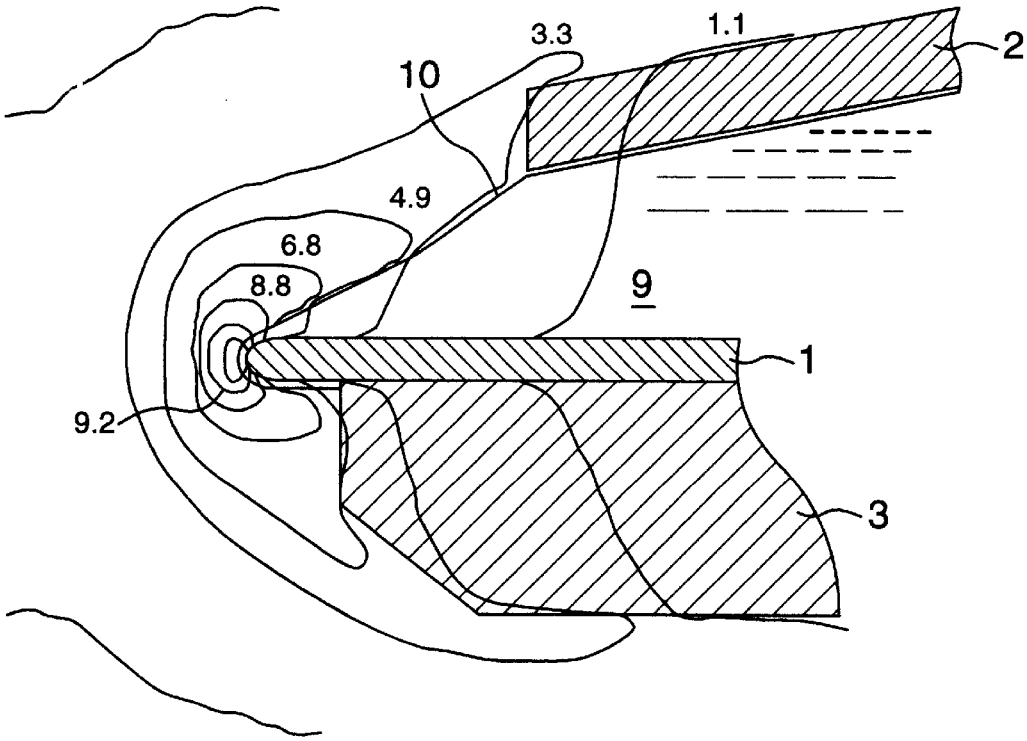
FIG. 3 is a view showing the calculation result of equi-field-strength curve in a cross-section of a tip of a recording electrode.

In this manner, the configuration of the meniscus uniquely determines the field strength around the tip of the recording electrode. FIG. 3 shows a distribution of the field strength in the vicinity of the recording electrode in a meniscus in the case where a potential difference of 1300 V is given between the recording electrode and the counter electrode. These values are obtained by the finite element analysis, and equi-field-strength curves in the vicinity of the recording electrode 1 and the ink meniscus 10 covering the recording electrode 1 are illustrated in the drawing. A unit for the values in the drawing is 106 V/m. It can be seen in this model that the field strength of about several MV/m exists in the end of the recording electrode.

<Ratio of forces>

Figure 4:
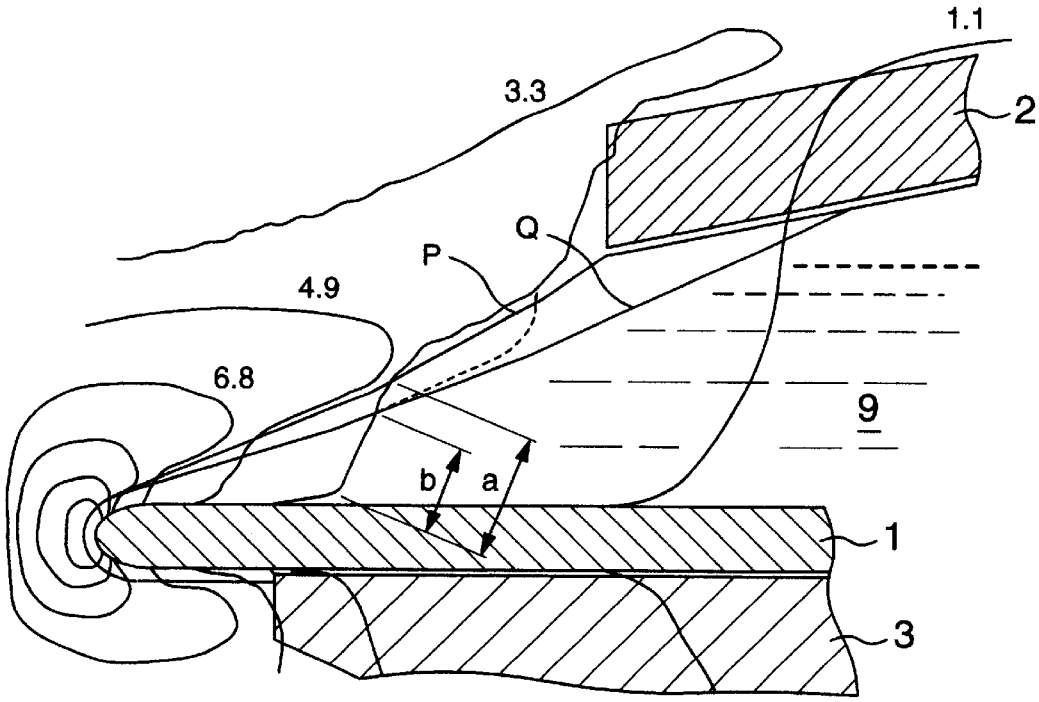
FIG. 4 is a view showing an equi-field-strength curve in a cross-section of a tip of a recording electrode.

FIG. 4 is an enlarged view of the tip of the recording electrode in FIG. 3. It can be seen that the field strength becomes larger as it goes to the tip of the recording electrode. In addition, the field strength becomes discontinuous at an interface between the ink meniscus and air. After that, the equi-field-strength curve is formed such that it first runs rearward and then returns to the tip to make a closed loop. Therefore, it is understood that both the carrier fluid and particles of coloring material contained therein are exerted by larger forces as it goes nearer the tip of the recording electrode. In other words, the larger the angle of the meniscus relative to the recording electrode, the larger forces the carrier fluid and particles of coloring material bear. FIG. 4 shows two meniscuses P and Q having the same distance from them to the tip of the recording electrode and different angles relative to the recording electrode. Also, the equi-field-strength curves of 3.3 MV/m for respective meniscuses are shown in the drawing. A solid line corresponds to the meniscus P, and a broken line to the meniscus Q. As seen from FIG. 4, with the meniscus P having a larger angle, an area bearing an electric pressure caused by the field strength of 3.3 MV/m corresponds to a height "a." On the other hand, with the meniscus Q having an angle smaller than that of the meniscus P, an area bearing an electric pressure caused by the field strength of 3.3 MV/m corresponds to a height b. Accordingly, a larger amount of the carrier fluid bears forces in the meniscus P to be discharged than that in the meniscus Q, so that printing densities are made uneven due to difference of meniscuses. Thus it is estimated that the angle of the ink meniscus relative to the recording electrode is related to an amount of the carrier fluid which mainly bears the forces.

Figure 5:
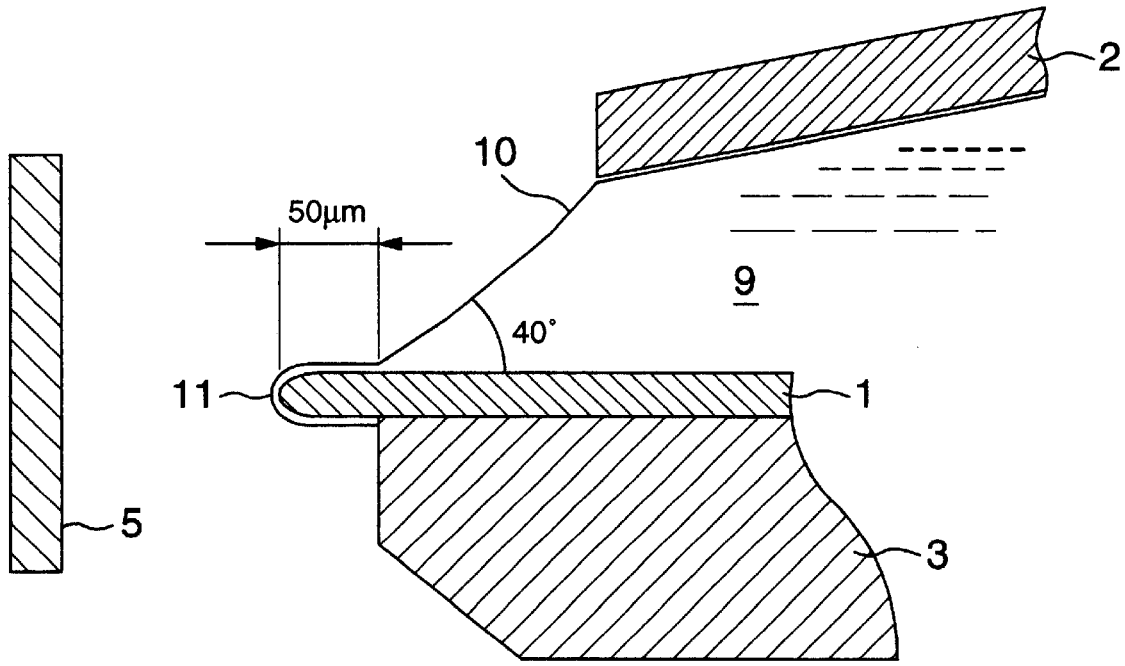
FIG. 5 is a cross-sectional view of a tip of a recording electrode in an edge type head according to an embodiment of the present invention.

On the other hand, as shown in FIG. 5, it will be described what happens when the meniscus is changed in position.

Even when the position of the meniscus retreats from the tip of the recording electrode, a certain amount of the carrier fluid 9 makes a thin layer 11 due to the capillary phenomenon and conveyed to the tip of the recording electrode. On the other hand, it is estimated that, when the position of the meniscus retreats, the particles of coloring material tends to be hard to be supplied to the tip of the recording electrode. Accordingly, when the meniscus is positioned near to the tip, the particles of coloring material bearing the forces are increased in number, and when the meniscus is positioned distant from the tip, vice versa. That is, when the meniscus is positioned near to the tip, a greater amount of the particles of coloring material bears the forces to be ejected than that when the meniscus is positioned distant from the tip. So, differences in the positions of the meniscus cause differences in printing densities. In this manner, it is estimated that the position of the meniscus is related to the number of the particles of coloring material bearing the forces.

Furthermore, the use of these effects in combination results in forces exerted on the carrier fluid and particles of coloring material balancing in a variety of combinations. As a result, it is possible to achieve a change in a wide range with respect to density. Accordingly, it is possible to realize optimum printing density, and so it is made possible to solve problems such as reduction of printing density, bleeding, offset and the like, and at the same time it is made possible to solve problems such as reduction in the range of color reproduction and in recording speed, and an increased cost caused by the high-temperature fixing process step, due to an excessive increase in density.

On the basis of the above theoretical consideration, the inventors of the invention have investigated a relation between the geometric dimensions of the meniscus configuration and the printing density and found that there is a close relation between them, thus leading to the present invention.

Hereinafter, embodiments of the present invention will be described with reference to FIGS. 5 to 7.

(First Embodiment)

FIG. 5 shows a meniscus 10 formed by ink 9 at a tip of a recording electrode 1 in a so-called edge type head. The edge type head has a feature in that a substrate, which forms the recording electrode, is disposed perpendicular to a counter electrode, and hence ink droplets are made to fly in a direction horizontal relative to the substrate. A positional relation of a nozzle or slit determines an angle of the meniscus 10 with respect to the recording electrode and a distance from the meniscus to the recording electrode. In FIG. 5, an end face of the top plate 2 is located a distance of 140 $\mu$m above the recording electrode 1, and a curved surface defined by the meniscus can be regarded as being approximately linear. An angle of the meniscus with respect to the recording electrode is set at 40°, and a distance from the meniscus to the tip of the recording electrode is set at 50 $\mu$m. When a potential difference is given between the recording electrode 1 and counter electrode (not shown) with such settings, it determines a distribution of the field strength in the vicinity of the recording electrode 1, and hence forces exerted on the particles of coloring material and the carrier fluid, and a ratio of the particles of coloring material and the carrier fluid in the ejected ink.

When an angle of the meniscus with respect to the recording electrode is set at approximately 20° and a distance from the meniscus to the tip of the recording electrode is set at approximately 50 $\mu$m, a ratio of the particles of coloring material is made large to enable obtaining a relatively high printing density. In addition, even when a position of the meniscus is made to suitably retreat from the tip of the recording electrode, forces acting on the carrier fluid become small to provide the same effect can be obtained.

Also, when an angle of the meniscus with respect to the recording electrode is set at approximately 60°, printing density rather decreases while permeation and evaporation of the carrier fluid immediately after printing make autonomous fixing possible. In addition, even when a position of the meniscus retreats much from the tip of the recording electrode, an amount of the particles of coloring material that moves to a flying position decreases with the result that a ratio of the carrier fluid in the ejected ink becomes large, and hence the same effect can be obtained.

In this manner, while adjustment of an angle and a position of the meniscus gives rise to differences in printing densities, a unique effect of the present invention cannot be actually found from mere theoretical considerations. For example, the further a distance from the meniscus to the tip of recording electrode, the less forces acting on the coloring material and the carrier fluid. However, such mere considerations don't bring about an understanding as to which of forces acting on the coloring material and the carrier fluid becomes smaller, so that it is not possible to imagine what happens in the printing density. Because forces acting on the carrier fluid decrease and an area bearing the forces decreases when the meniscus retreats in position, the forces acting on the carrier fluid decrease more rapidly than those acting on the particles of coloring material. Consequently, the printing density is expected to increase but actually not. In this case, as shown in the present invention, when the meniscus retreats a large distance from the tip of the recording electrode, the printing density begins decreasing after the meniscus retreats beyond a certain point. Such effect cannot be easily found from a mere theoretical inference.

The top plate 2 and base plate 3, respectively, are made of an insulator such as glass, plastics and the like. Plastics used is selected from materials that are resistant to components of the ink and are excellent in workability. For example, in the case where the ink contains an acrylic based resin, a material such as epoxy resin, polycarbonate and the like except acrylic based resins is selected. In addition, controlling the meniscus configuration can be facilitated by forming the top plate and base plate from a material having a bad wettability against the ink or making the top plate and base plate in a surface state which is hard to be made wet by the ink. For such purpose, the use of polytetrafluoroethylene is most preferable, and it is also possible to use an inexpensive material such as glass, polyimide and the like. Any material may be essentially used for the recording electrode so long as it is electrically conductive. For example, copper, gold, nickel, stainless steel or the like can be used for the recording electrode. In contrast to the top plate and base plate, it is preferable to use as the recording electrode a material wettable against the ink.

(Second Embodiment)

Figure 6:
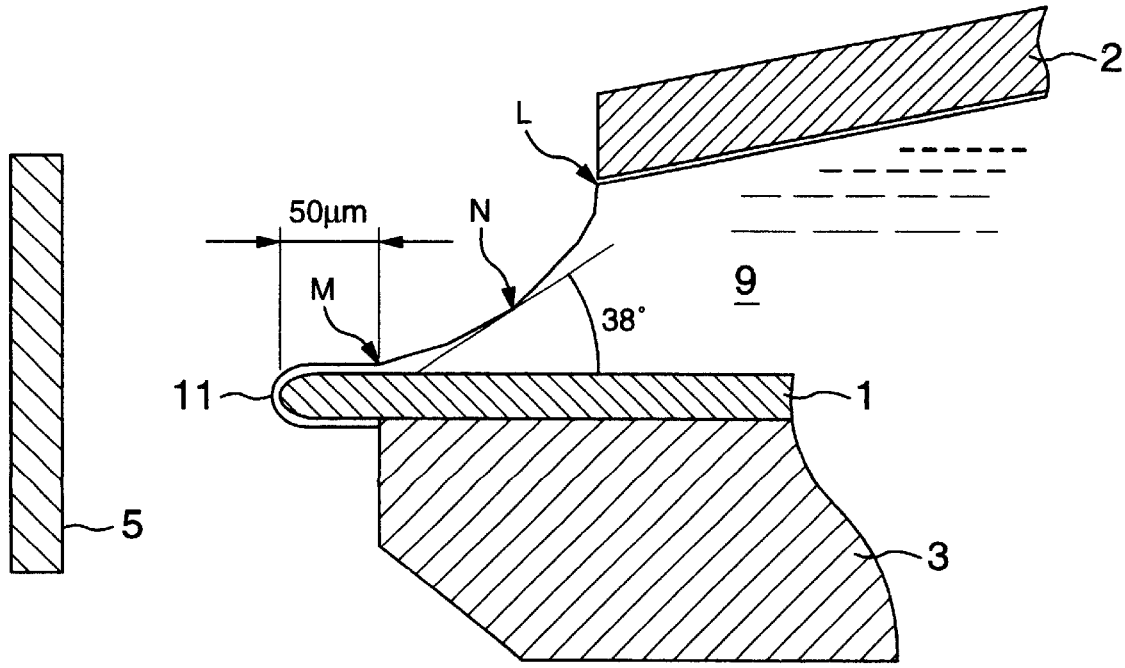
FIG. 6 is a cross-sectional view of a tip of a recording electrode in an edge type head according to another embodiment of the present invention.
Figure 7:
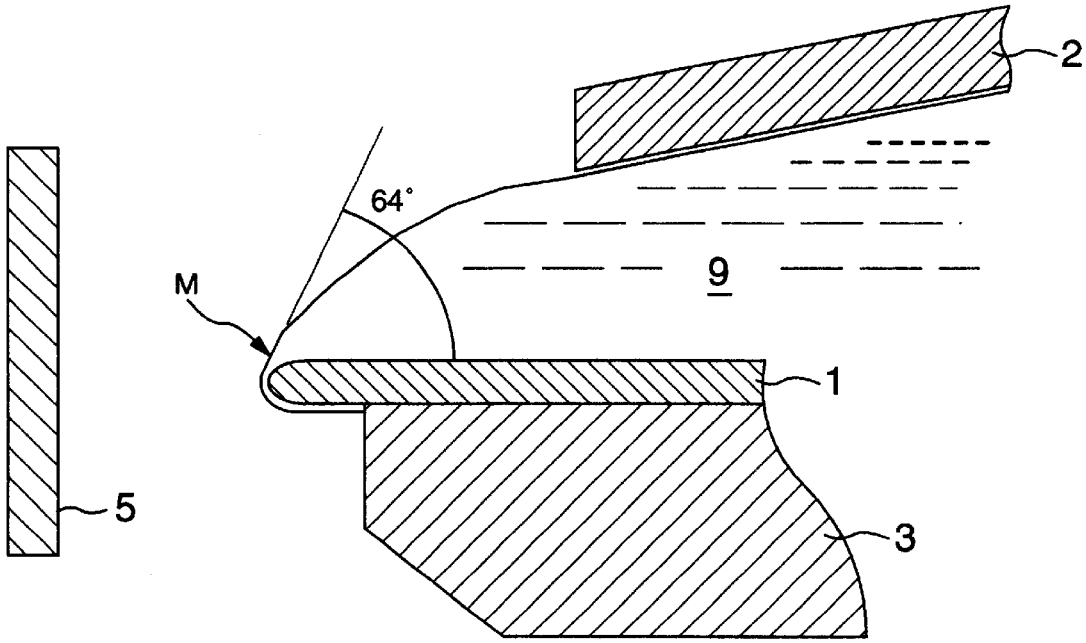
FIG. 7 is a cross-sectional view of a tip of a recording electrode in an edge type head according to still another embodiment of the present invention.

FIGS. 6 and 7 show several configurations of ink meniscus. FIG. 6 shows a meniscus having such a negative curvature that occurs when the ink pressure is negative. In such case, a contact angle between the meniscus and the recording electrode is always zero, and so it must be defined in a certain method. In order to determine an angle in such case, the inventors of the invention used an angle that a tangential line at a midpoint N in meniscus measurement between a tip M of the meniscus and a point L contacting to the top plate forms with the recording electrode. In this embodiment, it is possible to control a meniscus distance as well as a meniscus angle. The larger in negative the back pressure, the larger the distance, so that the ink is supplied by the capillary phenomenon from the tip of the meniscus to the tip of the recording electrode to form an ink layer 11.

On the other hand, as shown in FIG. 7, when the back pressure is set at a positive value, the curvature of the ink meniscus becomes positive. In this embodiment, the meniscus distance is always zero, and so only the meniscus angle can be controlled. In addition, it is possible to control only the larger meniscus angle than an angle that a line connecting the top plate and the tip of the recording electrode forms with the recording electrode.

The back pressure of the ink is most favorable in a range of −300 Pa or more but +500 Pa or less. When the back pressure is made to change within this range, it can easily adjust the meniscus angle in combination with the shape of a slit and a voltage applied. Therefore, it is possible to effectively control the printing density.

(Third Embodiment)

Figure 8:
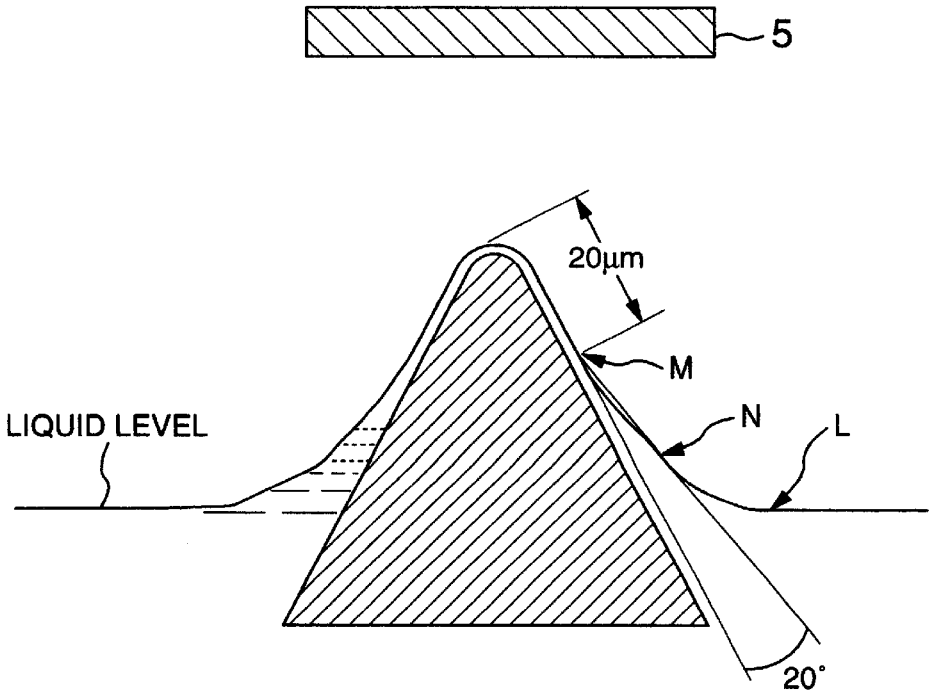
FIG. 8 is a cross-sectional view of a tip of a recording electrode in a side type head according to an embodiment of the present invention.

FIG. 8 shows a recording electrode in a so-called side type head. The side type head has a feature in that a substrate forming a recording electrode is parallel to a counter electrode, and so ink droplets fly in a direction perpendicular to the substrate. The present invention is also effective in this embodiment. FIG. 8 shows a case, in which a curvature is negative and an angle is defined in the same manner as that in FIG. 6. In FIG. 8, the meniscus distance is set at 20 μm, and the meniscus angle is set at 20°.

Example

Next, concrete examples in the invention will be described with reference to FIGS. 5, 9, and 10.

In the arrangement shown in FIG. 5, a recording electrode 1 was formed on a glass substrate 3 by using Ni plating to provide a semi-processed product having a thickness of 40 μm, and further using gold plating to add a thickness of approximately 10 μm to the semi-processed product. Polytetrafluoroethylene was worked to provide a top plate 2 which in turn was bonded to the glass substrate 3. Ink was used which was composed of a carrier fluid, which was ISOPARL manufactured by Exon Corp., particles of coloring material which was a blue pigment manufactured by Hoechist Corp. and containing copper phthalocyanine, a fixing resin which was a hydrocarbon resin having the molecular weight of about 20000, and a charging control agent which was naphthenic acid manganese (metal soap). In addition, isopropyl alcohol was used as a dielectric material. Electric conditions were such that a DC voltage between the recording electrode and counter electrode was set at −1.5 kV, and a pulse voltage was set at +500V. A distance between the tip of the recording electrode and the counter electrode was fixed at 1.5 mm. Regular paper 4024 manufactured by Xerox Corp., was used as the recording medium. In addition, the optical density was measured using SPM100-II manufactured by Gretag Corp., and Standard illuminant D65. The optical density was evaluated by means of values defined by −Log (reflectance). In addition, chromaticity and lightness were evaluated in (a*2+b*2)0.5 and L*, respectively, in the L*a*b* system.

Figure 9:
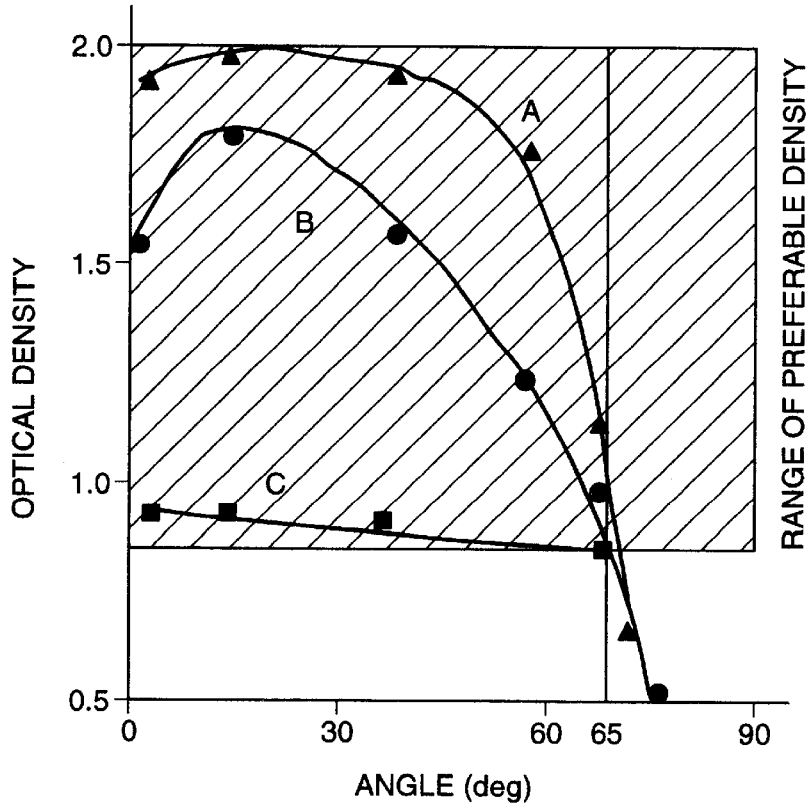
FIG. 9 is a graph showing a relationship between meniscus angles and optical densities, indicating the present invention.

FIG. 9 shows the result of investigating a relation between the meniscus angle and the optical density in this arrangement. In the drawing, characters A, B, and C indicate results of measurement using three types of ink having different components. Contents of the charging control agent and dielectric material in the respective inks are listed in Table 1.

TABLE 1

| | A | B | C |
|---|---|---|---|
| Charging control agent (wt. %) | 0.001 | 0.1 | 6.0 |
| Dielectric material (wt. %) | 0.001 | 2.0 | 10.0 |

FIG. 9 shows a range of the density thought to be preferable for obtaining a high-quality image. An appropriate value of the optical density is determined according to a recording medium, on which printing is performed, and a color of the ink. For example, even with the same ink, the printing density on exclusive paper is higher than that on regular paper, so that a printing density optimum for the exclusive paper can be set at a lower value than that for the regular paper. In addition, because a yellow component has no significant influence on image quality even if somewhat small in quantity, its target printing density may be low as compared with those of other colors. In this manner, although preferable ranges of printing densities cannot be unconditionally limited, the inventors of this application generally determined 0.8 to 2.0 as an optimum ranges of printing densities by finding the greatest common measures for optimum ranges in various recording media and all the colors. When the printing density is lower than 0.8, an image will result which is exceedingly weak in contrast and light as compared with general printed matters. On the contrary, when the printing density is 2.0 or higher, chromaticity and lightness decreases in a color image. Although the image becomes clear in profile, it presents a generally hard image quality which is free of transparency and remarkably degrades as compared with the general printed matters. This is because there is a certain relationship between density, chromaticity and lightness. Also, with color images, preferable ranges for chromaticity and lightness are set to be 30 and higher, and 45 and higher, respectively, in order to obtain high image quality. For comparison, values of typical optical density, chromaticity, and lightness with respect to water-soluble ink jet printers put on the market are within the ranges of 1.2–1.6, 25–50, and 50–90, respectively, in the case of regular paper.

As shown in FIG. 9, except the case of a meniscus angle being near zero, it was observed that the optical density as well as the meniscus angle decreased in the respective inks. If the meniscus angle is near zero, the properties opposite to the tendency described above revealed themselves. This cannot be inferred from theoretical considerations. The carrier fluid is too small in thickness at a location where the meniscus angle is small, and so the mobility of the particles of coloring material possibly becomes different from that in a normal state. In any case, the manner of such change cannot be elucidated.

The printing density changed in a manner closest to a linear manner in the case where ink was used which contained 1 to 8% of alcohol content. In addition, while the printing density changes largely and gently depending upon a kind of ink, it was found from other experimental results that whatever ink was used, the printing density ranged between 0.8 and 2.0 so long as the meniscus angle was set within a range of 0 to 65°.

In addition, when an ink ejection opening is positioned at a level as high as 200 μm or more, a meniscus often assumes a curve as shown in FIG. 6. Also in this case, the inventors of the present application in investigated a relationship between the meniscus angle and the printing density on the basis of the definition of the meniscus angle described above, and found that an upper limit of the meniscus angle for reproduced the optimum density was 70°. While the optimum density can be achieved also beyond the range of 65° according to the configuration of the meniscus, it is possible to also in and larger, the optimum printing density can be obtained in whatever configuration of the meniscus provided that the meniscus angle is set in a range of 650° and smaller.

Although not shown, a relationship between the meniscus angle and the optical density was investigated with a distance from the meniscus to the tip of a recording electrode being 100 μm, and the meniscus angle varied from 0 to 65°, with the result that, when the angle was 15°, the optical density was obtained which corresponded to 1.8. In addition, color measurement on a printed matter at this time resulted in chromaticity and lightness, which assumes proper values corresponding to 31.1 and 63.6, respectively. Furthermore, measurement of recording frequencies resulted in that frequency response was observed to be 9 kHz. The in printed matter was tested with respect to its fixing property by means of a bending test method and a peeling method with a mending tape, with the result that the fixing state was excellent.

In addition, when the radius of curvature of the recording electrode was made under the same conditions to be 20 μm, the optical density was as high as 2.1, but both the chromaticity and lightness were as low as 17.0, and 40.2, respectively. In addition, since the particles of coloring material attached to the recording paper in three-dimensional manner, the printed portions were easily smudged due to scratching by a finger to be worse in fixing property.

When the recording electrode assumed a radius of curvature in a range of 40 to 500 μm, however, the field strength changed in concentration degree, so that ratios, at which the particles of coloring material and the carrier fluid bore forces, varied to enable achieving the optimum printing density.

The result of the measurements with the position of the meniscus fixed has been described above while the printing density is made to correspond to the meniscus angle even if the position of the meniscus is set at any distance within a range of 1500 μm and shorter.

With a head having an application in printing intended for common use such as mass production, it is preferable to set the distance at 1000 μm or less from the viewpoint of cost and maintenance. In particular, it is most suitable to set the distance at 800 μm or less in terms of stability of the meniscus. On the other hand, with a printer head for business and professional use, the head may be costly, so that the position of the meniscus may be at any distance of 1500 μm or less. In addition, the inventors of the present application confirmed a similar effect with a needle-shaped electrode of stainless steel. In this case, it was found that the optimum range of the density could be achieved over the distance of 1500 μm or more. However, an optimum printing density can be obtained in heads having various configurations by setting the position of the meniscus at 1500 μm or less.

Figure 10:
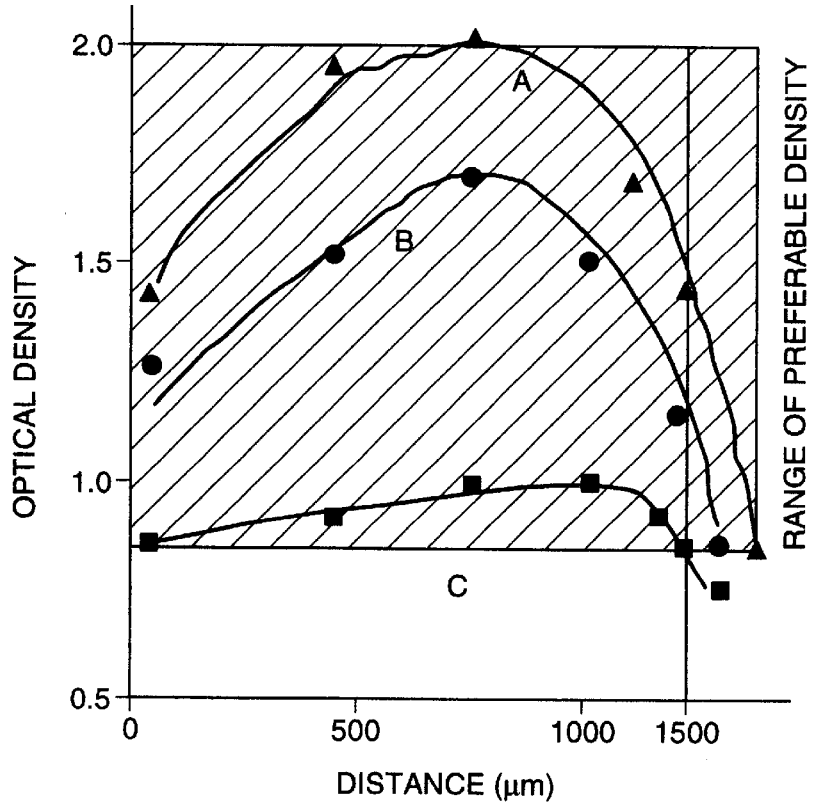
FIG. 10 is a graph showing a relationship between meniscus distances and optical densities, indicating the present invention.
Figure 11:
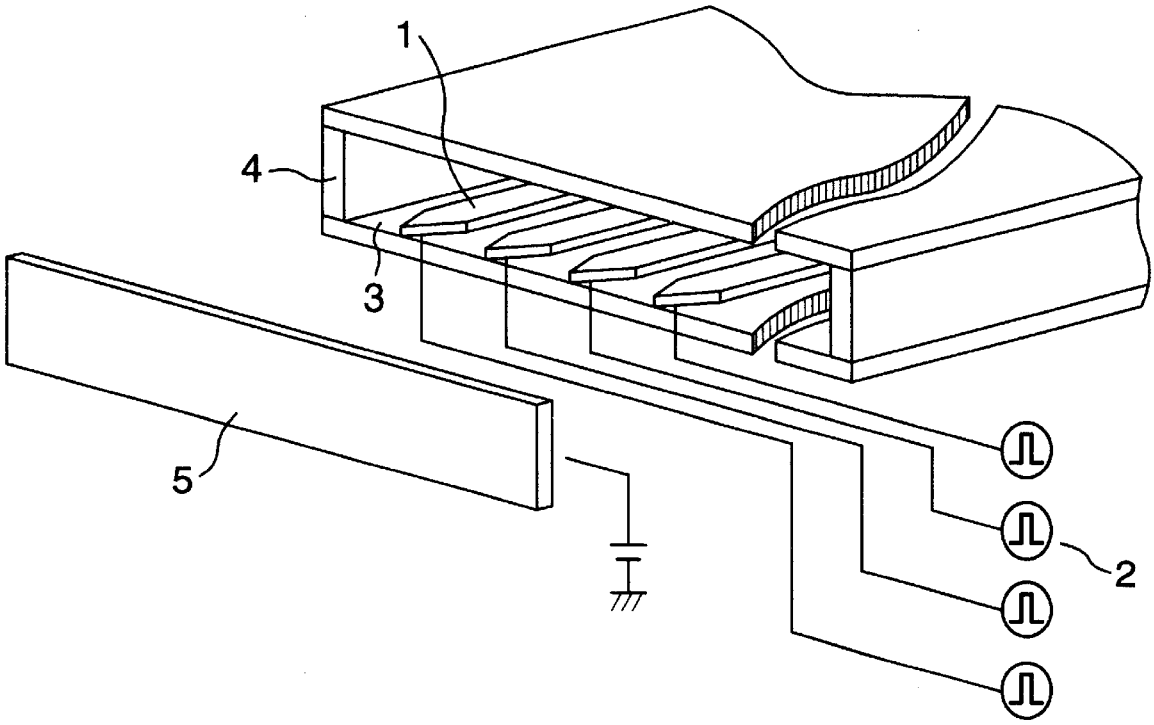
FIG. 11 is a perspective view showing a conventional electrostatic ink jet head.

Next, FIG. 10 shows a result of an experiment in the structure shown in FIG. 5, in which a relationship between the position of the meniscus and the optical density was investigated with the meniscus angle fixed at 30° and the position of the meniscus changed. In this case, the meniscus distance of zero means that the tip of the recording electrode is included in the meniscus. On the contrary, the meniscus distance of 1500 μm is realized when the meniscus retreats 1500 μm rearward from the tip of the recording electrode. At this time, the meniscus was positioned 1500 μm rearward from the tip of the recording electrode, and the ink was carried 1500 μm from the meniscus to the tip of the recording electrode due to the capillary phenomenon. Therefore, a thin ink layer 11 covered the entire recording electrode. Three kinds of inks described above were used also in this experiment. The optical density once increased along with the meniscus distance, and then decreased. When the meniscus distance was small, forces acting on the carrier fluid and an area receiving the forces increased, so that it is inferred that much of the carrier fluid would be ejected along with the particles of coloring material and hence the printing density would decrease. It follows from this inference that, when the distance became large on the contrary, the ratio of the carrier fluid would decrease, but the data were not in line with the inference. FIG. 10 shows that, when the distance was over 300 μm, the printing density decreased again. While the reason for this also is not clear, it is thought that, when the meniscus distance became large, the mobility of the particles of coloring material significantly decreased. These effects also cannot be deduced by mere inference.

In the above setting, the largest change in the printing density amounted to 1.0 to 2.0 in the event of using the ink A. With this ink, when the meniscus distance was 180 μm, the optical density, chromaticity and lightness were 1.9, 32.8, and 75.7, respectively, which provided favorable data. In addition, the fixing property was self-fixing one without the need of heating to be in a favorable state. The recording frequency was achieved to correspond to 13.5 kHz.

While the above-described data were obtained with cyan ink, the similar tendencies were obtained also with magenta ink and yellow inks. Accordingly, the optimum printing density can be obtained in each of all the three colors including cyan, magenta and yellow in the case where an associated head has meniscus dimensions prescribed in the present invention.

As described above, in an electrostatic ink jet recording apparatus comprising an ink containing particles of coloring material fully or partially dissolved or dispersed in a solvent, an ink chamber receiving the ink, a ejection opening communicating with the ink chamber, an ink flow passage communicating from the ink chamber to the ejection opening, a recording electrode disposed in the ejection opening, and a counter electrode provided facing the recording electrode, and for flying the ink by applying a recording signal voltage between the recording electrode and the counter electrode, optimum values of the density of coloring material, chromaticity, lightness, fixing property and recording frequency of the ink placed on a recording medium can be obtained by setting an angle of an ink meniscus relative to a tip of the recording electrode or a distance from the tip of the recording electrode to the ink meniscus at predetermined values.

What is claimed is:

1. An electrostatic ink jet recording apparatus comprising:

an ink chamber receiving therein an ink containing particles of coloring material dispersed in a solvent, an ejection opening communicating with the ink chamber, an ink flow passage communicating from the ink chamber to the ejection opening, a recording electrode disposed in the ejection opening, and a counter electrode provided to face the recording electrode and for flying the ink by applying a recording signal voltage between the recording electrode and the counter electrode, wherein an angle formed between (i) a meniscus of the ink attached to a tip of the recording electrode and (ii) the recording electrode ranges from 0 to 65°, wherein a distance between said meniscus and said tip of the recording electrode ranges from 0 to 1500 $\mu$m, and wherein said tip of the recording electrode has a radius of curvature that ranges from 40 to 500 $\mu$m.

2. The electrostatic ink jet recording apparatus according to claim 1, wherein back pressure on the ink is in a range of −300 to 500 Pa.

3. The electrostatic ink jet recording apparatus according to claim 1, wherein a voltage applied between the recording electrode and the counter electrode is composed of a dc voltage and a pulse voltage.

4. The electrostatic ink jet recording apparatus according to claim 1, wherein said ink contains a dielectric material in an amount ranging from 0.001 to 10 wt. % of the ink.

* * * * *